United States Patent [19]

Johnston

[11] 4,064,652

[45] Dec. 27, 1977

[54] DOOR HOLD-OPEN MECHANISM

[75] Inventor: Laird E. Johnston, Birmingham, Mich.

[73] Assignee: General Motors Corporation, Detroit, Mich.

[21] Appl. No.: 690,527

[22] Filed: May 27, 1976

[51] Int. Cl.[2] ..... E05B 65/06; E05C 17/00

[52] U.S. Cl. ..... 49/394; 292/DIG. 17

[58] Field of Search ..... 49/383, 394; 16/143, 16/144, 145, 139; 292/DIG. 17, 333

[56] References Cited

U.S. PATENT DOCUMENTS

| | | | |
|---|---|---|---|
| 390,418 | 10/1888 | Tilton | 49/394 X |
| 1,026,813 | 5/1912 | Landine | 16/144 X |
| 1,846,842 | 2/1932 | Butler | 49/394 X |
| 3,336,066 | 8/1967 | Knapp | 292/DIG. 17 |

*Primary Examiner*—Kenneth Downey
*Attorney, Agent, or Firm*—John P. Moran

[57] ABSTRACT

A door hold-open mechanism operatively connected to an upper door hinge member and including a combination latch wheel and detent plate, a detent plunger operable with the detent plate and a latch segment operable with the latch wheel, the arrangement adapted to provide a conventional two-position opening operation upon partial actuation of a door handle, or a predetermined number more than two hold-open positions upon full actuation of the door handle.

4 Claims, 3 Drawing Figures

DOOR HOLD-OPEN MECHANISM

This invention relates generally to door hinge mechanisms and, more particularly, to such mechanisms adapted to produce more than two door hold-open positions.

While present door hold-open mechanisms are generally satisfactory in operation, it is desirable to have such a mechanism which includes more than the usual two door hold-open positions, namely, fully open and open to some one intermediate position.

Accordingly, an object of the invention is to provide an improved door hold-open mechanism which is adapted to provide more than two door hold-open positions, and which moves smoothly through either the opening or closing arc to or from the selected positions, by passing any intermediate available positions without contacting same.

Another object of the invention is to provide an improved door hold-open mechanism which is adapted to provide either a conventional two-position opening operation upon partial actuation of either the inner or outer door handles, or a predetermined greater than two-position opening operation upon full actuation of either of the door handles.

A further object of the invention is to provide a door hold-open mechanism including a toothed latch wheel, a detent plate secured to the latch wheel and including fewer teeth and valleys than the latch wheel, and a latch segment (1) which is urged away from the latch wheel upon full actuation of a door handle and adapted to reengage the latch wheel at any selected intermediate door opening location upon release of the handle, providing a predetermined number more than two available open positions, and (2) which is retained in contact with the latch wheel upon partial actuation of the handle and initial opening of the door, thereby rotating the latch wheel and the associated detent plate along with the door as the latter's opening operation is continued and thereby causing a spring loaded detent plunger mounted on the front pillar to be cammed out of the adjacent valley of the detent plate to progressively enter the next two valleys providing the conventional two open positions.

These and other objects and advantages of the invention will be apparent when reference is made to the following description and accompanying drawings, wherein.

Figure 1:
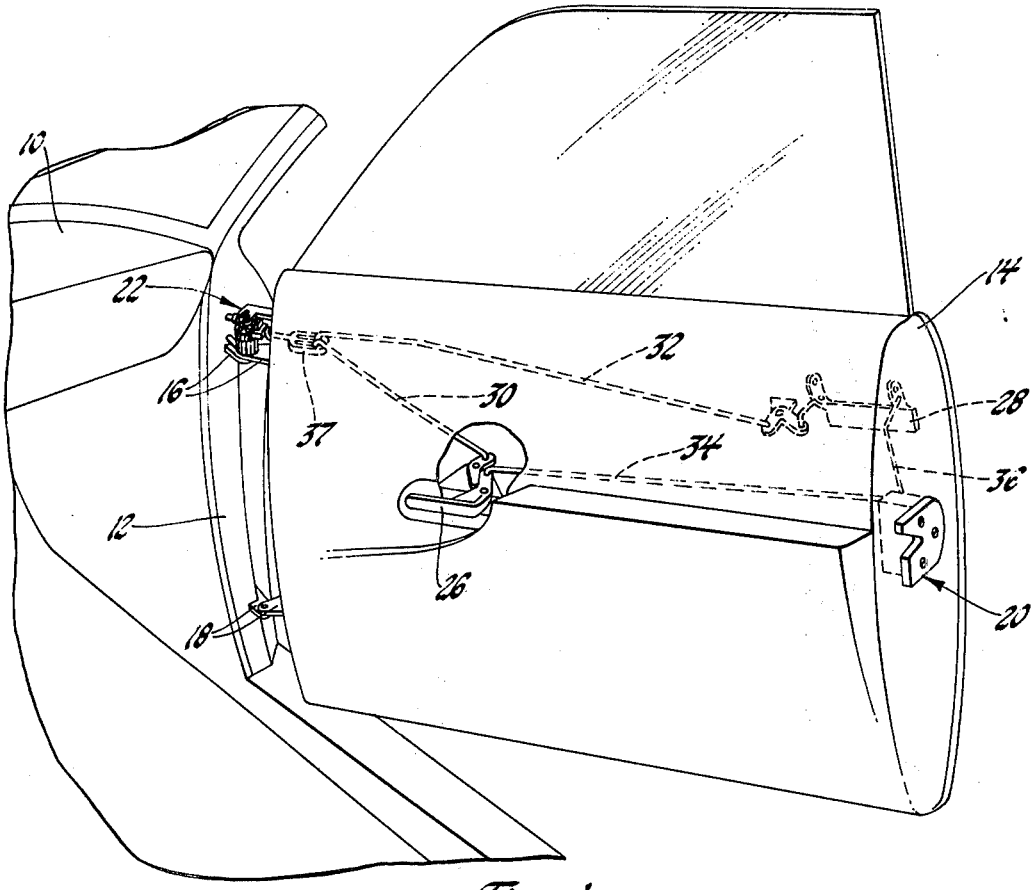
FIG. 1 is a fragmentary perspective view of a motor vehicle embodying the invention.
Figure 2:
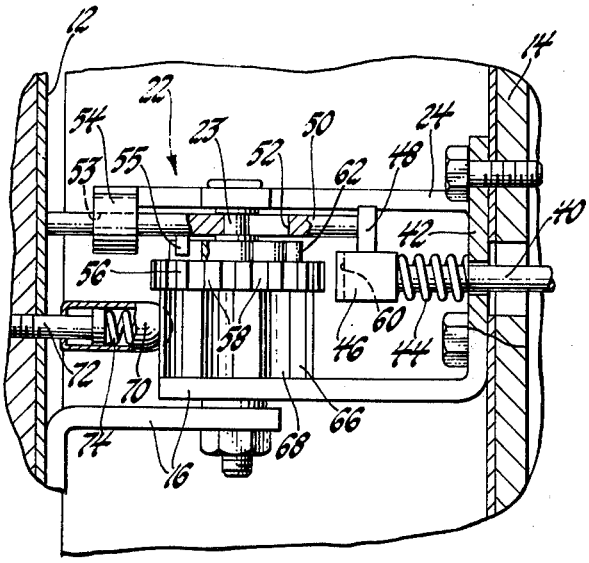
FIG. 2 is an enlarged fragmentary cross-sectional view of the invention.

Referring now to the drawings in greater detail, FIG. 1 illustrates a vehicle body 10 including a front door supporting pillar 12 having a door 14 supported thereon by means of upper and lower hinges 16 and 18, respectively. A door latch member 20 is mounted on an edge of the door 14 and adapted to operatively connect with a rear pillar (not shown) when the door 14 is in a closed position.

Figure 3:
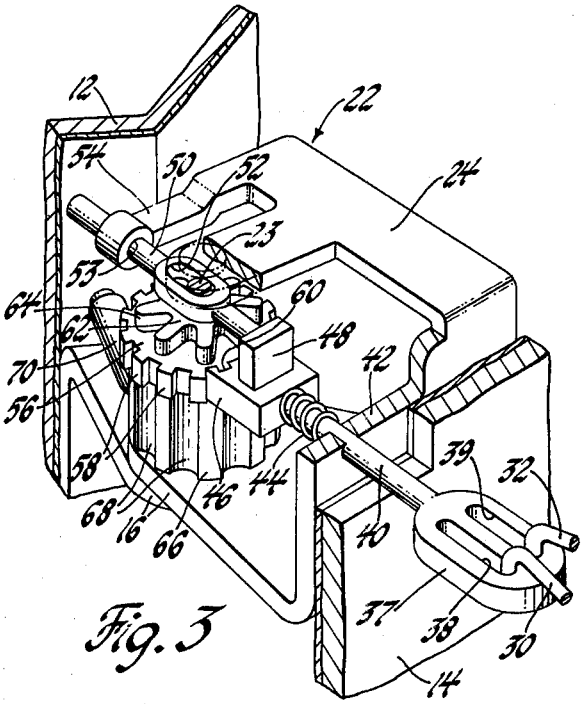
FIG. 3 is a fragmentary perspective view of the elements of FIG. 1 and particular operative position.

The door hold-open mechanism 22 is pivotally mounted on a hinge pin 23 at the lower end thereof to the upper hinge 16 and at the upper end thereof to a bracket 24 (FIG. 3) formed on an inside wall of the door 14. Conventional inner and outer door handles 26 and 28 respectively are operatively mounted on the door 14 and connected through typical linkage members 30 and 32 to the door hold-open mechanism 22, and via additional typical linkage members 34 and 36, respectively, to the latch member 20.

The door hold-open mechanism 22 includes a slip joint member 37 including parallel slots 38 and 39 for lost motion connection with the respective linkage members 30 and 32, responsive to actuation of either of the inner or outer door handles 26 and 28. A rod 40 is connected to the front end of the slip joint member 37 for extension forwardly through an abutment 42 formed on an inner surface of the door 14. A latch spring 44 is mounted around the rod 40 forward of the abutment 42 for selected compression between the abutment 42 and a latch segment 46 formed on the front end of the rod 40 in response to the movement of the slip joint member 37. A stop member 48 is formed on an upper surface of the latch segment 46, aligned with an index pawl 50, the latter including a slot 52 slidably mounted around the hinge pin 23 adjacent the bracket 24. The index pawl 50 is retained in alignment with the stop member 48 by virtue of extending through an opening 53 formed in a support member 54 extending from the inner wall of the door 14 parallel to the bracket 24. The forward end of the index pawl 50 is adapted to abut against the front pillar 12. A downwardly extending index pin 55 is formed on the index pawl 50 at an intermediate location therealong for a purpose to be described.

A latch wheel 56 having teeth 58 formed therearound is fixedly mounted on the pin 23 in horizontal alignment with a matching contoured surface 60 formed on the forward end of the latch segment 46. An index cam 62 having teeth 64 formed therearound is secured to the upper face of the latch wheel 56. There are a predetermined lesser number of teeth 64 on the index cam 62 than the number of teeth 58 formed on the latch wheel 56. A detent plate 66 having a predetermined number of recesses 68 formed therearound is fixedly secured to the bottom face of the latch wheel 56. A detent plunger 70 is slidably mounted on a rod-like member 72 secured to the front pillar 12 in horizontal alignment with the detent plate 66. The plunger 70 is urged away from the member 72 and into contact with the adjacent recess 68 of the detent plate 66 by a spring 74 mounted between respective end faces of the member 72 and the plunger 70.

In operation, for a more than two position door opening operation, the latch segment 46 and its contoured surface 60 are held away from the teeth 58 of the latch 56, against the force of the spring 44 upon full actuation of either the inner or outer handles 26 or 28 of the door latch assembly via the respective linkage members 30 and 32 and the associated slip joint member 37. The door 14 may then be opened to any desired position whereupon the contoured surface 60 of the latch segment 46 will reengage with the adjacent teeth 58 of the latch wheel 56 in the selected door position upon release of either of the handles 26 or 28.

For a conventional two position door opening operation, the handle 26 or handle 28 is actuated to a predetermined intermediate position, whereupon the latch assembly will, nevertheless, be released from the rear pillar via the movement of either of the linkage members 34 and 36. During such partial actuation of either of the handles 26 or 28, once the door 14 has been opened through a predetermined small angle, the latch segment 46 will engage the teeth 58 of the latch wheel 56, the latch spring 44 serving to urge the index pawl 50 forwardly into the space adjacent the pillar 12 created by the initial opening of the door 14. Rotation of the latch wheel 56 and its associated detent plate 66 cams the detent plunger 70 out of the adjacent recess 68 of the detent plate 66, and thence progressively into the next two approaching recesses 68 to provide a conventional two-position door hold-open action.

During the door closing operation, the index pawl 50 abuts against the pillar 12 and is urged into contact with the stop member 48 of the latch segment 46, thereby disengaging the latch segment 46 from the latch wheel 56 against the force of the spring 44, and the index pin 55 formed on the index pawl 50 is forced into a valley between adjacent teeth 64 of the index cam 62, serving to rotate the index cam 62 accordingly, and, thus, the latch wheel 56 and the detent plate 66 to a position wherein these members are reset for the next opening cycle. At the same time, the detent plunger 70 reengages the adjacent recess 68 of the detent plate 66, also reset for the next opening cycle.

It should be apparent that the invention provides a door hold-open mechanism having more than the usual two hold-open positions, while effectively eliminating any substantial "whip" of the door into a selected position.

It should be further apparent that the invention provides a means for providing either the conventional two hold-open positions or the opportunity for the operator to select any one of a predetermined greater plurality of hold-open positions, depending upon his partial or full actuation of either of the inner or outer door handles.

While but one embodiment of the invention has been shown and described, other modifications thereof are possible.

I claim:

1. A door hold-open mechanism for use with a vehicular door, door frame and door hinge, said mechanism comprising a door latch assembly including inner and outer door handles, a latch wheel having a predetermined number of teeth formed thereon and operatively connected between said door and said door hinge, an index cam and a detent plate fixedly secured to oppositely disposed faces of said latch wheel and having a predetermined lesser number of teeth formed thereon than the number on said latch wheel, a latch segment operatively connected to said door latch assembly and having an end face contoured to match said teeth on said latch wheel, resilient means operatively connected to said latch segment for urging said contoured end face of said latch segment into engagement with said latch wheel, said latch segment being retained away from said latch wheel against the force of said resilient means upon actuation of said door latch assembly via one of said handles for permitting manual opening of said door to any of a predetermined plurality of desired hold-open positions whereupon release of said one of said handles permits said latch segment to be urged by said resilient means into engagement with said latch wheel, a spring-loaded detent plunger mounted on said door frame and biased into contact with a valley of said toothed detent plate for retaining said door in a selected open position, an index pawl slidably mounted on said door and adapted to abut against said door frame and contact said latch segment for disengaging said latch segment from said latch wheel while said door is being closed without said door latch assembly being actuated, and an index pin mounted on said index pawl for engaging said index cam during the closing movement of said door and rotating said index cam to a position wherein said index cam and, hence said latch wheel are reset for the next opening cycle.

2. A door hold-open mechanism for use with a vehicular door, door frame and door hinge, said mechanism comprising a door latch assembly, a latch operatively connected between said door and said door hinge, a detent plate and an index cam fixedly secured to oppositely disposed faces of said latch wheel and each having the same number of teeth formed thereon, there being a predetermined greater number of teeth formed on said latch wheel than on said detent plate and on said index cam, a spring-loaded latch segment operatively connected to said door latch assembly and urged toward said latch wheel, an end face formed on said latch segment adapted to engage said teeth on said latch wheel, said latch segment being retained away from said latch wheel, upon full actuation of said door latch assembly for opening said door to any of a predetermined plurality of desired hold-open positions, a spring-loaded detent plunger mounted on said door frame and biased into contact with a valley of said toothed detent plate for providing a two-position door hold-open action when said door latch assembly is partially actuated so as to become unlatched from said door frame and for retaining said door in a selected open position, an index pawl slidably mounted on said door and adapted to abut against said door frame and contact said latch segment for disengaging said latch segment from said latch wheel while said door is being closed without said door latch assembly being actuated, said latch segment reengaging said latch wheel during initial opening of said door while said door latch assembly is being partially actuated, and an index pin mounted on said index pawl for engaging said index cam while said door is being closed and rotating said index cam and, hence, said detent plate to a position wherein said detent plunger reengages said detent plate reset for the next opening cycle.

3. A door hold-open mechanism for use with a vehicular door, door frame, and upper and lower door hinges, said mechanism comprising a door latch member, inner and outer handles operatively mounted on said door, actuator means within said door, first linkage means connected between said actuator means and said inner and outer handles, second linkage means connected between said inner and outer handles and said door latch member, a bracket formed on an inner surface of said door, a hinge pin mounted through said bracket and said upper door hinge, a latch wheel having teeth formed thereon and being mounted around said hinge pin intermediate said bracket and said upper hinge, a detent plate and an index cam fixedly secured to oppositely disposed faces of said latch wheel and each having the same number of teeth formed thereon, there being a predetermined greater number of teeth formed on said latch wheel than on said detent plate and on said index cam, a rod extending from said actuator means through an abutment formed on an inner surface of said door, a latch segment formed on the extended end of said rod, coil spring compressed between said latch segment and said abutment, a contoured surface formed on the forward face of said latch segment suitable for meshing with said teeth of said latch wheel and urged toward said latch wheel by said coil spring, said latch segment being retained away from said latch wheel by said first linkage means and said actuator means upon full actuation of one said inner and outer handles for opening said door to any of a predetermined plurality of desired hold-open positions, a spring-loaded detent plunger mounted on said door frame and biased into contact with a valley of said toothed detent plate for providing a two-position door hold-open action when one of said inner and outer handles is partially actuated so as to unlatch said latch member an index pawl slidably mounted on said hinge pin and adapted to abut against said door frame and contact said latch segment for disengaging said latch segment from said latch wheel while said door is being closed without said inner and outer door handles being actuated, and an index pin mounted on said index pawl for engaging said index cam while said door is being closed and rotating said index cam and, hence, said detent plate to a position wherein said detent plunger reengages said detent plate reset for the next opening cycle.

4. A door hold-open mechanism for use with a vehicular door, door frame, and upper and lower door hinges, said mechanism comprising a door latch member, inner and outer handles operatively mounted on said door, a slip joint member within said door, first and second linkage members connected between said slip joint member and said inner and outer handles, respectively, third and fourth linkage members connected between said respective inner and outer handles and said door latch member, a bracket formed on and inner surface of said door, a hinge pin mounted through said bracket and said upper door hinge, a latch wheel having teeth formed thereon and being mounted around said hinge pin intermediate said bracket and said upper hinge, a detent plate and an index cam fixedly secured to oppositely disposed faces of said latch wheel and each having the same number of teeth formed thereon, there being a predetermined greater number of teeth formed on said latch wheel than on said detent plate and on said index cam, a rod extending from said slip joint member through an abutment formed on an inner surface of said door, a latch segment formed on the extended end of said rod, a coil spring compressed between said latch segment and said abutment, a contoured surface formed on the forward face of said latch segment and urged toward said latch wheel by said coil spring, said latch segment being retained away from said latch wheel upon full actuation of one of said inner and outer handles for opening said door to any of a predetermined plurality of desired hold-open positions, a spring-loaded detent plunger mounted on said door frame and biased into contact with a valley of said toothed detent plate for providing a two-position door hold-open action when one of said inner and outer handles is partially actuated so as to unlatch said latch member, an index pawl slidably mounted on said hinge pin and adapted to abut against said door frame and contact said latch segment for disengaging said latch segment from said latch wheel while said door is being closed without said inner and outer door handles being actuated, said latch segment reengaging said latch wheel during initial opening of said door while said door latch assembly is being partially actuated, and an index pin mounted on said index pawl for engaging said index cam while said door is being closed and rotating said index cam and, hence, said detent plate to a position wherein said detent plunger reengages said detent plate reset for the next opening cycle.

* * * * *